US005215194A

United States Patent [19]

Blanford et al.

[11] Patent Number: 5,215,194

[45] Date of Patent: Jun. 1, 1993

[54] GOLF BAG FOR USE WITH CARTS

[76] Inventors: Linda A. Blanford, Rte. 2, Box 228, Springfield, Ky. 40069; Michael R. Ferris, 12 One If By La., Feeding Hills, Mass. 01030; William P. Jacoby, Jr., 4607 Hedge Row Ct., Louisville, Ky. 40220; John M. Krzynowek, 3 Ward Dr., Wilbraham, Mass. 01095

[21] Appl. No.: 737,954

[22] Filed: Jul. 30, 1991

[51] Int. Cl.[5] ..... A63B 55/00; A63B 55/08

[52] U.S. Cl. ..... 206/315.3; 206/315.5; 206/315.6; 280/DIG. 5; 280/DIG. 6

[58] Field of Search ..... 206/315.2–315.8; 280/DIG. 5, DIG. 6

[56] References Cited

U.S. PATENT DOCUMENTS

| | | | |
|---|---|---|---|
| Re. 33,203 | 4/1990 | Reimers | 206/315.3 X |
| 2,436,688 | 2/1948 | Corbett | 206/315.5 X |
| 2,698,040 | 12/1954 | Wilkins | 206/315.5 X |
| 2,749,958 | 6/1956 | Innes | 206/315.6 X |
| 2,751,955 | 6/1956 | Nahon | 206/315.6 |
| 2,861,614 | 11/1958 | Kish, Jr. | 206/315.5 X |
| 2,866,490 | 12/1958 | Thompson | 206/315.6 X |
| 3,259,160 | 7/1966 | Penna | 206/315.5 |
| 3,674,072 | 7/1972 | Shuto | 206/315.6 |
| 3,815,699 | 6/1974 | Ganskopp et al. | 280/DIG. 5 X |
| 4,249,586 | 2/1981 | Setani | 206/315.5 X |
| 4,282,912 | 8/1981 | Brown | 206/315.6 X |
| 4,356,875 | 11/1982 | Clune | 280/DIG. 5 X |
| 4,383,563 | 5/1983 | Kirchhoff, Jr. | 206/315.3 X |
| 4,509,643 | 4/1985 | Rhee | 206/315.6 X |
| 4,685,561 | 8/1987 | Reimers | 206/315.6 |
| 4,709,814 | 12/1987 | Antonious | 206/315.3 |
| 4,750,617 | 6/1988 | Anderson et al. | 206/315.5 X |
| 4,768,650 | 9/1988 | Chancellor, Jr. | 206/315.6 X |
| 4,778,136 | 10/1988 | Reimers | 206/315.5 X |
| 4,881,638 | 11/1989 | Cho | 206/315.3 |
| 4,915,221 | 4/1990 | Spangler | 206/315.6 |
| 5,038,984 | 8/1991 | Izzo | 206/315.3 X |
| 5,123,531 | 6/1991 | Beretta | 206/315.6 X |

FOREIGN PATENT DOCUMENTS

| | | | |
|---|---|---|---|
| 2-189289 | 7/1990 | Japan | 280/DIG. 5 |

*Primary Examiner*—Sue A. Weaver

[57] ABSTRACT

A bag for carrying golf clubs and related equipment comprising a rigid lower base; a tubular spacer connected at its lower end to the base and defining a body having a front face, rear face and side faces, the spacer being sufficiently rigid to retain its axial length for retaining golf clubs therein; a rigid collar connected to the upper edge of the spacer, the collar adapted for the receipt of golf clubs positioned with the handle end of the golf clubs extending downward through the spacer to the base, the distance between the upper edge of the collar and the base at the front face being less than the distance between the upper edge of the collar and the base at the rear face; cross bars coupled across the interior of the collar, the cross bar located closer to the front face being lower than the cross bar located closer to the rear face; a carrying handle and a shoulder strap connected to the front face of the spacer; and pocket members connected to the side and front faces of the spacer at elevations beneath the handle whereby access to these pockets is unimpaired by the golf cart and its strap.

9 Claims, 5 Drawing Sheets

GOLF BAG FOR USE WITH CARTS

BACKGROUND OF THE INVENTION

1. Summary of the Invention

This invention relates to a golf bag for use with golf carts and, more particularly, to an improved golf bag specifically designed for use with golf carts and having an oppositely sloped upper edge for the receipt of golf clubs and with pockets located remote from the rear face at an elevation below the handle.

2. Description of the Background Art

In the field of golf bags, it is the normal practice for the golf bag to be provided with a shoulder strap and handle on the front face and with the upper edge angling downwardly from the front face. When a caddie thus holds the bag by the handle and tips it forward for club viewing, selection and removal by the player, the shorter irons are closest to the player, with the longer woods most remote and with the intermediate and long irons therebetween. In this manner, the player is provided with a good view of all the clubs to facilitate club selection and removal.

With the advent of golf carts, however, whether of the motorized type or the pull type, it is the practice to use such bags and to secure them on the backside of the cart. The cart is provided with a strap so that when the bag is placed with its rear face in contact with the back of the cart, and with its handle and shoulder strap exposed, the golf cart strap may be threaded through the handle.

When utilized in such manner, the wooden clubs are closest to the player with the short irons most remote and with the intermediate and long irons therebetween. Thus, when playing with a conventional golf bag secured to a golf cart, the longer woods obscure the player's view of all the irons while the intermediate and long irons obscure the view of the short irons. Club viewing, selection and removal of the appropriate club is thereby rendered more difficult than necessary.

Another shortcoming of conventional golf bags being used with golf carts is the fact that golf bag pockets for the storage of golfing items, i.e. balls, tees, glove, sweater, etc., are normally located around the entire periphery of the bag and at all elevation heights along the bag's vertical extent. This is an additional inconvenience since items in the pockets desired by the golfer may be wedged between the bag and cart after the bag has been strapped in position. Further, by having the pockets at all locations along the elevational extent of the bag, the upper portions of the pockets will become constricted and inaccessible to the player due to the golf cart strap being secured through the handle of the bag.

Many types of golf bags are known today and are in the patent literature. Such golf bags provide one benefit or another. Consider for example U.S. Pat. Nos. 4,726,597 to Hickin; 4,778,136 to Reimers and Re. 33,203 to Reimers. Each of these patents describes a golf bag constructed for particular use with a golf cart or stand. In the Hickin device, not only is the golf bag of a specialized construction rendering it less suitable for non-golf cart use, but the golf cart itself also requires special construction. This effectively raises the cost and inconvenience of both the bag and cart when not used together. With regard to the Reimers patents, the disclosed golf bags are modified for use with golf stands. Here again the bag is rendered less suitable for use without a golf cart or without the stand due to the excess components which increase complexity, weight as well as cost of the bag.

In another grouping of patents, various bag constructions are disclosed which attempt to improve convenience when used with golf carts. Consider U.S. Pat. Nos. 2,749,958 to Innes; 4,282,912 to Brown; and 4,768,650 to Chancellor. In the Innes patent, the pockets are in various unusual orientations on a triangular base and no handle is employed to facilitate holding. In the Brown patent, the pockets are separately repositionable at various locations of the golf bag. Convenience is provided but at the expense of bag cost and complexity. Lastly, in the Chancellor patent, a rigid handle is utilized which is positionable through a hole in the carrying strap. In such arrangement the bag may be configured into a smaller cross sectional configuration for storage but no facility is provided to simplify use by the golfer when secured to a cart.

A third grouping of patents includes U.S. Pat. Nos. 4,383,563 to Kirchoff, Jr.; 4,709,814 to Antonious; 4,750,617 to Anderson and 4,915,221 to Spangler. Each of these patents recognizes the need for positioning a selected club in an orientation for being easily removed by the player. In each of these patents a rotary member is provided in the bag for rotating interior components to bring a specific club to a specific forward position for being removed by the player. In each of the instances, however, greater weight, complexity and cost is built into the bag rendering it of less desirability, particularly when used without a cart.

The last patent of interest is U.S. Pat. No. 4,796,752 to Reimers. Reimers identifies the desirability of angling the upper edge of a golf bag differently from the normal configuration in order to facilitate a player's viewing of the clubs as well as club selection, and removal from the bag, particularly when used in conjunction with a cart. Reimers, however, has the high point of its upper edge in the middle with downwardly sloping edges forwardly and rearwardly thereof. The upper edge of the collar is higher at the handle end than at the cart end. This construction only partially facilitates club viewing, selection and removal. Further, Reimers does not recognize the desirability of having pockets out of contact with the golf cart and at an elevation below the handle to render the pockets less likely to be constricted by a strap holding the bag in place.

None of these golf bags described in the prior art patent literature is designed for maximizing its use either with or without a cart.

As evidenced by the above referred to patents as well as the commercial devices, a wide variety of golf bags have been designed for use with or without golf carts. No prior patent or commercial device, however, is directed to the combination of advantageous features as intended herein.

Accordingly, it is an object of the present invention to provide an improved bag for carrying golf clubs and related equipment comprising a rigid lower base; a tubular spacer connected at its lower end to the base and defining a body having a front face, rear face and side faces, the spacer being sufficiently rigid to retain its axial length for retaining golf clubs therein; a rigid collar connected to the upper edge of the spacer, the collar adapted for the receipt of golf clubs positioned with the handle end of the golf clubs extending downward through the spacer to the base, the distance between the upper edge of the collar and the base at the front face being less than the distance between the upper edge of the collar and the base at the rear face; cross bars coupled across the interior of the collar, the cross bar located closer to the front face being lower than the cross bar located closer to the rear face; a carrying handle and a shoulder strap connected to the front face of the spacer; and pocket members connected to the side and front faces of the spacer at elevations beneath the handle whereby access to these pockets is unimpaired by the golf cart and its strap.

It is a further object of the present invention to facilitate the viewing, selection and removal of golf clubs from a golf bag secured to a golf cart.

It is a further object of the present invention to locate the pockets of a golf cart in such orientation peripherally and elevationally so as to maximize usable pocket space when the bag is coupled to a golf cart.

Lastly, it is an object of the present invention to maximize the convenience and utility of golf bags when used with golf carts.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into an improved bag for carrying golf clubs and related equipment comprising a rigid lower base; a tubular spacer connected at its lower end to the base and defining a body having a front face, rear face and side faces, the spacer being sufficiently rigid to retain its axial length for retaining golf clubs therein; a rigid collar connected to the upper edge of the spacer, the collar adapted for the receipt of golf clubs positioned with the handle end of the golf clubs extending downward through the spacer to the base, the distance between the upper edge of the collar and the base at the front face being less than the distance between the upper edge of the collar and the base at the rear face; cross bars coupled across the interior of the collar, the cross bar located closer to the front face being lower than the cross bar located closer to the rear face; a carrying handle and a shoulder strap connected to the front face of the spacer; and pocket members connected to the side and front faces of the spacer at elevations beneath the handle whereby access to these pockets is unimpaired by the golf cart and its strap.

The invention may also be incorporated into a bag for carrying golf clubs comprising a rigid lower base; rigid spacer connected at its lower end to the base and defining a tubular body having a front face, rear face and side faces; a handle coupled to the front face; and a rigid collar connected to the upper edge of the spacer, the rigid collar adapted for the receipt of golf clubs positioned therein with the handle end of the golf clubs extending downwardly to the base, the distance between the upper edge of the collar and the base at the front face being less than the distance between the upper edge of the collar and the base at the rear face.

The base, spacer and collar each have a circular cross sectional configuration. The handle is secured at its upper end to the spacer adjacent to the collar. The bag further includes a shoulder strap having its upper edge secured to the spacer adjacent to the collar and with the lower edge thereof secured to the spacer below the midpoint thereof. The bag further includes supplemental belt loops secured to the spacer on opposite sides of the handle at a common elevational height. The bag further includes a pair of cross bars within the rigid collar, the rigid cross bar closer to the rear face being at an elevational orientation higher than the cross bar adjacent to the front face. The bag further includes sheets, each secured to an associated cross bar and to the base for separating golf clubs located within the bag. The bag further includes a plurality of pockets secured to the spacer at the front end side faces for the receipt and storage of golfing equipment, the upper edges of the pockets being at an elevational orientation beneath the handle. The rear face of the bag is devoid of pockets for positioning the bag adjacent a golf cart.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

Shown in the various drawings is a golf bag for carrying out the principles of the present invention. For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
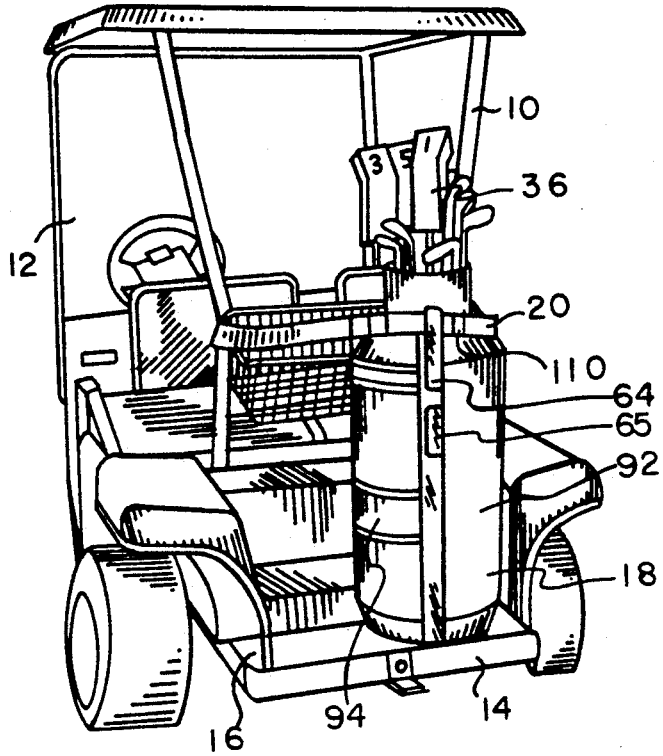
FIG. 1 is a perspective illustration of a powered golf cart holding a golf bag constructed in accordance with the principles of the present invention.

With particular reference to FIG. 1, there is shown a golf cart 10 of the powered variety. It includes a space 12 in which the players may ride and drive the vehicle. At the rear end 14 thereof is a base plate 16 for receiving one or a pair of golf bags 18. The shown golf bag 10 is constructed in accordance with the principles of the present invention. Each golf bag receiving plate 16 has associated therewith a strap 20 or pair of straps, each of which may couple and uncouple through a buckle to allow the placing, securement and removal of the golf bag 18 or bags with respect to the cart 10.

Figure 2:
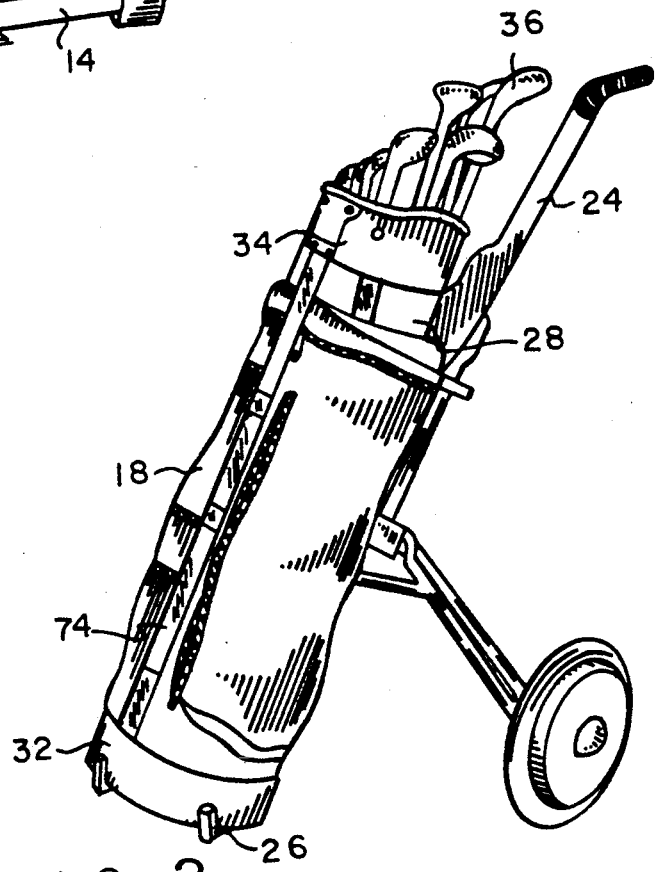
FIG. 2 is a perspective illustration of the golf bag shown in FIG. 1 but supported on a golf cart of the pull type.
Figure 3:
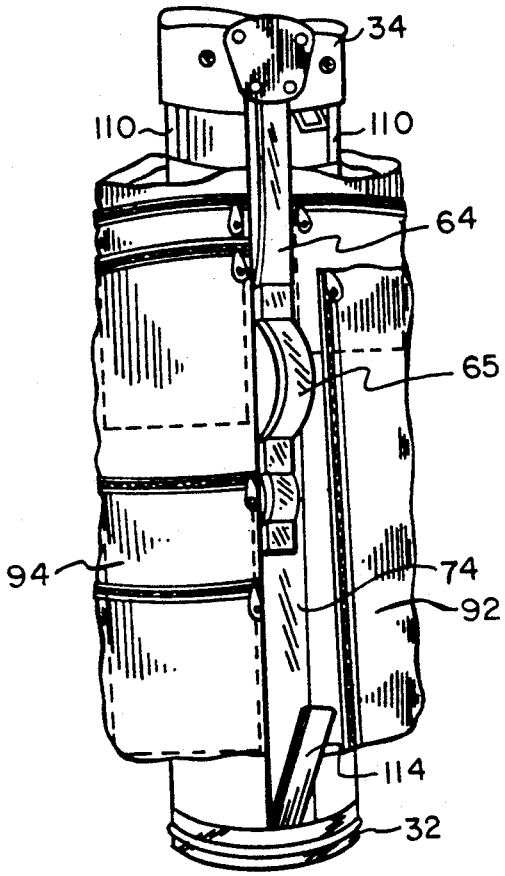
FIG. 3 is a front perspective illustration of the golf cart of FIGS. 1 and 2 shown independent of a golf cart.
Figure 4:
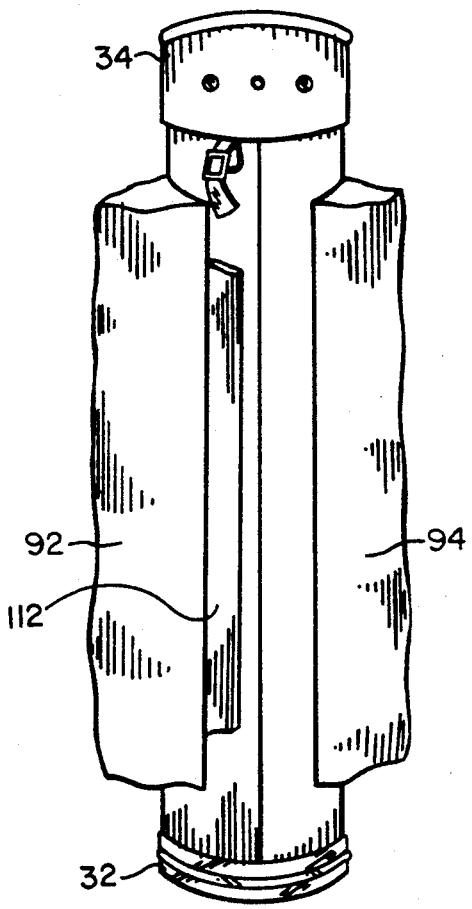
FIG. 4 is an elevational view of the rear face of the golf bag of FIGS. 1 through 3.
Figure 5:
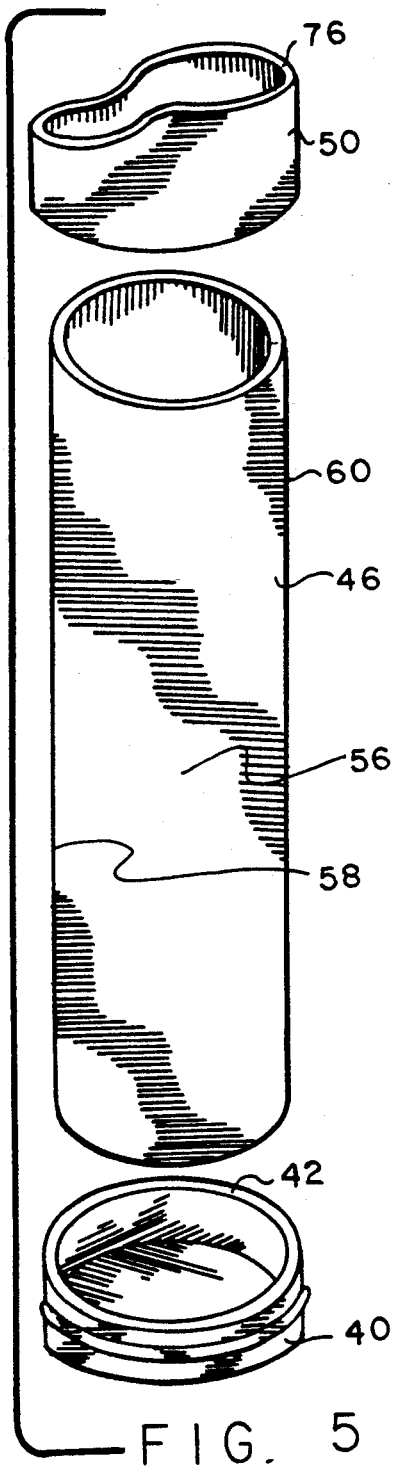
FIG. 5 is an exploded perspective view of the intermediate tubular spacer with lower base and upper collar.
Figure 6:
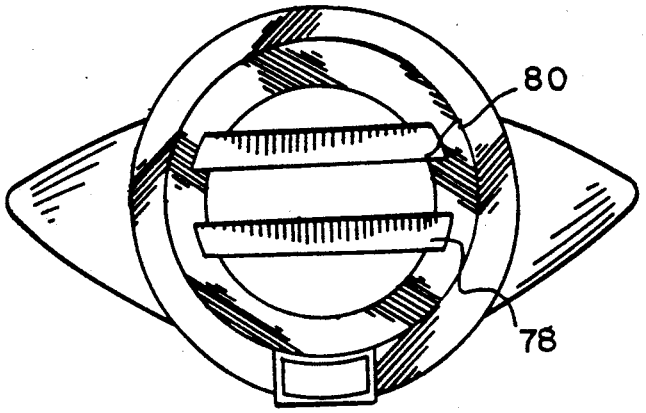
FIG. 6 is a top plan view of the golf bag of FIGS. 1 through 4.
Figure 7:
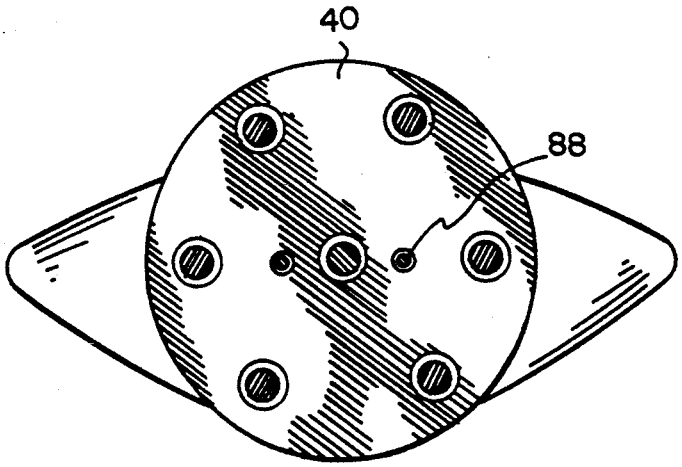
FIG. 7 is a bottom view of the bag of FIGS. 1 through 4 and 6.
Figure 8:
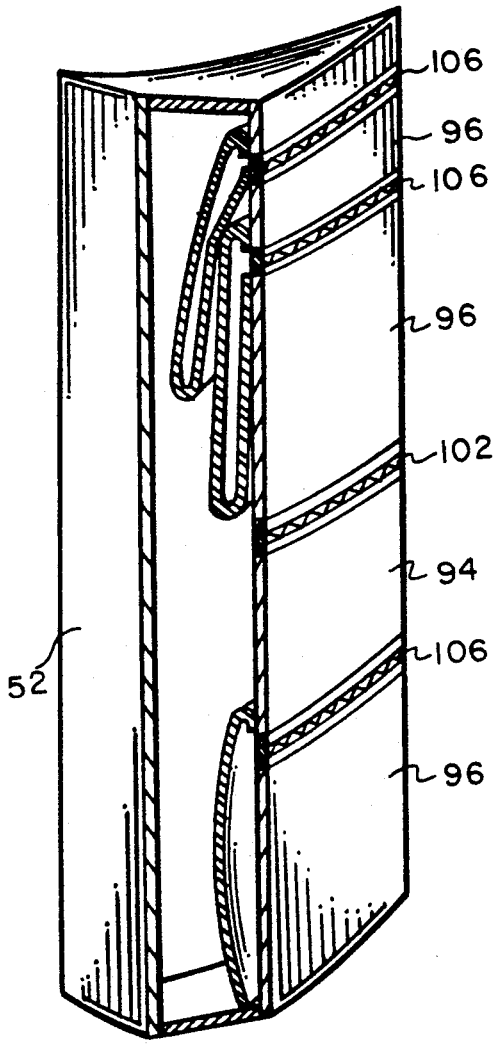
FIGS. 8 and 9 are sectional views of the pockets of the bag of the prior Figures.
Figure 9:
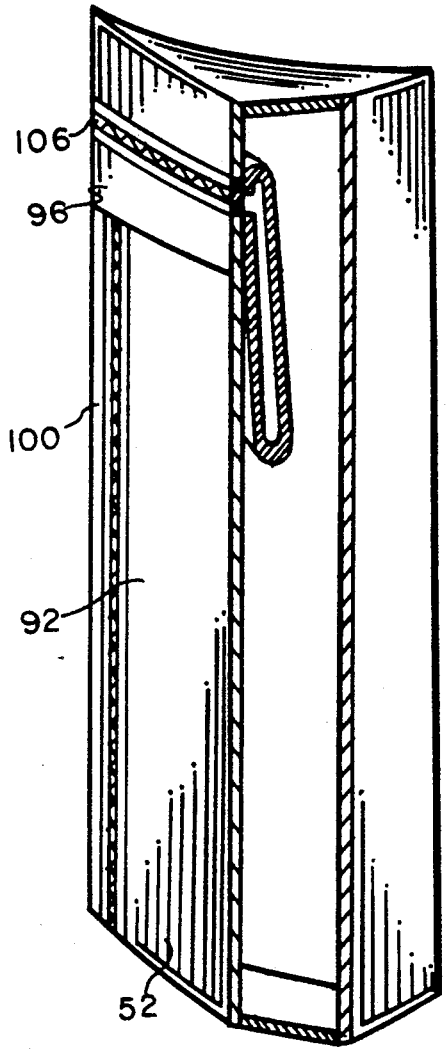

FIG. 2 illustrates the golf bag of FIG. 1, also constructed in accordance with the principles of the present invention. The golf bag, however, is illustrated as being supported on a golf cart 24 of the pull type. The golf cart includes lower support members 26 formed as rods with upturned ends upon which is supported the base of the golf bag. A strap 28 with a conventional buckle arrangement is secured to the golf cart for being threaded through the handle of the golf bag for releasably coupling the golf bag to the golf cart.

In accordance with the present invention, the golf bag 18 of the preferred embodiment is a generally tubular device closed at the bottom end 32 and open at the top end 34 in which golf clubs 36 are placed, handle end extending downwardly, to be supported from the bottom. At the lower end of the golf bag is the base 40, shown in the preferred embodiment as circular with an upstanding flange 42. Downwardly extending dimples are formed in the base. The base is of a relatively rigid material preferably a stiff plastic such as an ABS or similar material for extended life during the adverse and diverse climatic conditions experienced during the play of golf, as well as during storage through the non-golfing season.

Next adjacent and immediately above the rigid lower base is a tubular spacer 46. The tubular spacer is a tube 46 of generally rigid material, preferably polyethylene or polystyrene or the like, adapted to retain its tubular shape during normal usage. Most importantly, however, is that the tube 46 has sufficient rigidity so that when oriented with its lower edge coupled to the rigid lower base as by stitching and its upper edge coupled to a rigid collar 50, also by stitching, it will maintain the axial separation between the collar 50 and the base 40. The tube 46 is sufficiently strong to receive and support the golf clubs with their handle ends resting on the upper surface of the base and with their upper ends extending a particular distance thereabove. The rigid collar 50 is preferably of the same material as that of the base 40.

Stitched to the exterior surface of the tubular spacer 46 is a layer of cloth 52. The cloth 52 is basically for aesthetic purposes and is preferably of a synthetic material such as a woven fabric of an essentially inextensible material, as for example nylon. It is a particular color and design to meet the desires of the user. The tubular spacer 46 as well as the covering cloth 52 define opposite side faces 56 as well as a front face 58 and a rear face 60. The rear face 60 of the tubular spacer 46 and cloth 52 and of the bag 18 generally is adapted to be in contact with the rear face of the golf cart. The front face 58 is adapted to be diametrically opposed from the rear face 60 and remote from the golf cart. The front face 58 includes an upper handle 64 at the upper extent and an intermediate handle 65 at an intermediate extent. The handle 64 is at a height whereby the upper portion thereof is above the upper edges of the pockets 92 and 94 to allow passage of strap 20 or 28 therethrough without interfering with the use of the pockets. The front face 58 also includes a shoulder strap 66 with its upper end 68 secured at the upper extent of the bag and the lower end 70 located below the midpoint of the axial length of the bag, tube and covering cloth.

Securement of the cloth 52 to the tubular support spacer 46 is preferably by stitching at its lower and upper circumferences whereat it is stitched to the lower base 40 and upper collar 50. Vertical stitching is also provided at the center of the front face 58 to preclude rotation of the cloth 50 with respect to the tubular spacer 40. In addition, a supplemental length of vertically extended heavier cloth 74, as for example nylon webbing, extends along the length of the front face from the upper collar 50 to the lower base 40. Such cloth 74 is stitched around its periphery to the primary cloth 52 and tube 46 and provides a support to which is stitched the handle 64 and the shoulder strap 66 at their opposite ends. The strap 66 is provided with foam padding for convenience and comfort to a person carrying the bag.

At the upper edge of the rigid tubular member 46 is the rigid collar 50. The collar 50 is attached to the upper edge of the tubular spacer 46 by stitching to preclude inadvertent rotation. The collar 50 provides a generally circular cross sectional opening into which the golf clubs are positioned with their lower handle ends resting on the upper surface of the rigid lower base 40.

Note is taken of the angling of the upper edge 76 of the collar 50. In a normal golf bag the upper edge of the collar at the rear face is lower and closer to the base than the upper edge of the collar at the forward face. This has been the normal practice in order to accommodate golfers without golf carts so that when held by a caddie the shorter irons are closer to the player with the longer wooden clubs most remote therefrom and with the intermediate length irons and long irons therebetween. In this manner, visibility of the clubs for club selection and removal from the bag is thereby facilitated. When such a conventional orientation is utilized with a golf cart, the view of the shorter clubs is obscured and club selection and removal is hindered.

In accordance with the present invention, a reverse orientation of the upper edge 76 provides the shorter iron clubs adjacent to the front face 58 with the longer wood clubs remote therefrom and with the intermediate and long irons therebetween for maximizing club viewing, selection and removal when used with a golf cart having the strap threaded through the handle.

In association with the reverse angling of the upper edge 76 of the collar 40, cross bars 78 and 80 are provided for separating the three groups of clubs from each other but not in the conventional manner. According to the present invention, the cross bar 78 closer to the front edge and handle, along with the front upper edge, is at a lower elevation and closer to the base 40 than the cross bar 80 adjacent to the rear face 60 which, along with the rear upper edge, is at a further distance from the base 40. In this manner, separation of the clubs and viewing and selection is further enhanced. A plush type fabric covers the upper rigid collar and the cross bars for protection of the clubs and for enhanced appearance purposes.

Sheets 84 and 86 as of nylon or the like are located with their upper ends individually looped around an associated cross bar and stitched. A layer of nylon tricot knit covers the exterior of each sheet 84 and 86 where it loops around its cross bar. Their lower ends are secured to the base 40 with a rivet 88 through the base and the lower end of each sheet. Club separation and protection is thereby enhanced.

As in most conventional golf bags, major pockets 92 and 94 are also provided for the carrying of equipment related to the play of golf as for example balls, tees, glove, sweater, etc. In this context the broad concept of pockets secured to a golf bag is conventional. In their implementation and construction, however, the pockets of the present invention are different with regard to their circumferential placement, their longitudinal placement, and their functions. With regard to elevational orientation, by having the pockets located entirely below the handle, the placement of the golf club strap through the handle will not restrict access thereto by the player. With regard to circumferential orientation, the pockets are on the side and front face and not on the rear face whereat they would be constricted by a golf cart when coupled thereto.

Shown in the preferred embodiment are two major pockets 92 and 94 and four minor pockets 96. The major pockets are attached at their inner periphery by stitching to the exterior cloth 52 and the tubular spacer member 46. The major pockets have zippers 100, one vertical and one horizontal to allow large objects to be placed into and removed from the bag. The smaller pockets 96 are secured within the major pockets 92 and 94 as through peripheral stitching with each having a smaller zipper 106 for allowing access to and removal of smaller objects. The fabric of the smaller pockets is located within the major pockets.

Also formed on the golf bag of the present invention are a pair of smaller belt loops 110 at an elevational height the same as that of the handle. These loops 110 are vertically oriented so that the securement strap of the golf cart may be threaded through such belt loops as well as the handle for greater securement of the golf bag to the golf cart. Additional features include a tube of fabric 112 with a vertical axis stitched to the fabric of the golf bag for receiving an umbrella. A fabric loop at the lower end thereof is adapted to receive the tip of the umbrella remote from the handle. Lastly, an additional loop 114 is provided adjacent to the base of the golf bag. Loop 114 has the function of assisting in the handling of the bag, as for example, during lifting.

Figure 10:
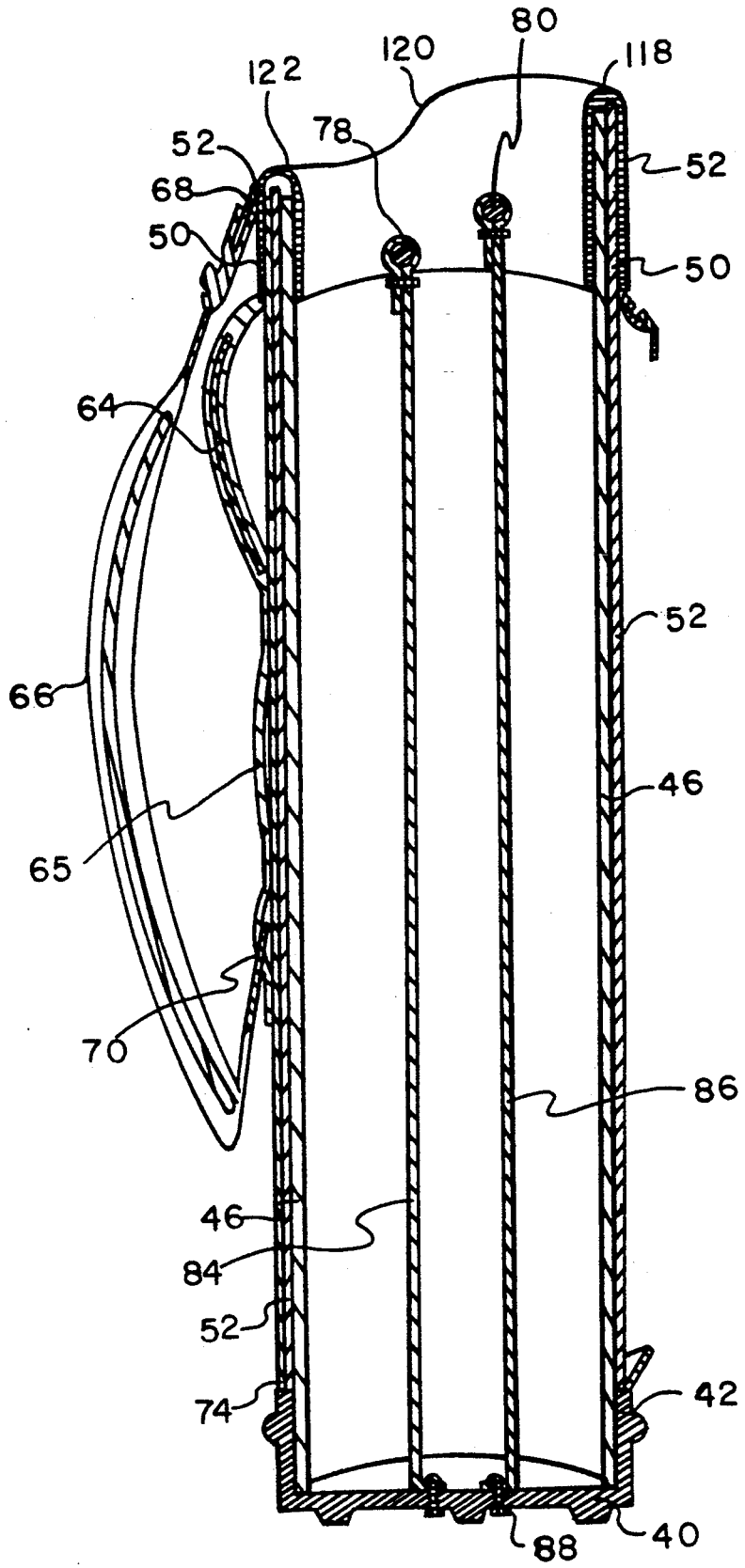
FIG. 10 is a sectional view through the central vertical axis of the golf bag of the prior Figures.

As can be seen particularly in FIG. 10, that portion 118 of the upper edge of the collar adjacent to the rear face is higher than any other point of the upper edge. The intermediate portion 120 of the upper edge of the collar is at an intermediate height. A horizontal extent couples the rear and intermediate portions 118 and 120. That portion 122 of the upper edge of the collar adjacent to the front face is at an elevation lower than any other point of the upper edge. Consequently, the distance between the upper edge of the collar and the base at the front face is less than the distance between the upper edge of the collar and the base at the rear face. No portion of the upper edge of the collar is lower than that portion 122 adjacent to the front face while no portion of the collar is higher than that portion 118 adjacent to the rear face.

In view of this reverse orientation of the upper edge of the collar, the acts of club viewing, selection and removal are enhanced. Similarly, by having the pockets removed from the rear face and at an elevational location beneath the handle there is no wasted pocket space caused by the securing strap of the golf cart. The use of pockets is maximized to thereby minimize inconvenience to the player as would occur with conventional bags known within the prior art. All things considered, the bag 18 of the present invention is readily adapted for use with golf carts for maximum utility while retaining good utility when used in situations without a golf cart.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A bag for carrying golf clubs and related equipment comprising:

a rigid lower base;

a tubular spacer connected at its lower end to the base and defining a body having a front face, rear face and side faces, the spacer being sufficiently rigid to retain its axial length for retaining golf clubs therein;

a rigid collar connected to the upper edge of the spacer, the collar adapted for the receipt of golf clubs positioned with the handle end of the golf clubs extending downward through the spacer to the base, the distance between the upper edge of the collar and the base at the front face being less than the distance between the upper edge of the collar and the base at the rear face;

cross bars coupled across the interior of the collar, the cross bar located closer to the front face being lower than the cross bar located closer to the rear face;

a shoulder strap and carrying handle connected to the front face of the spacer; and pocket members connected to the side and front faces of the spacer at elevations beneath the upper edge of the handle whereby access to the pockets is unimpaired when the bag is positioned on a golf cart and secured by a golf cart strap passing through the handle.

2. A bag for carrying golf clubs comprising:

a rigid lower base;

rigid spacer having an upper end a lower end connected at its lower end to the base and defining a tubular body having a front face, rear face and side faces;

a handle coupled to the front face;

a rigid collar connected to the upper end of the spacer, the rigid collar adapted for the receipt of golf clubs positioned therein with the handle end of the golf clubs extending downwardly to the base, the distance between the upper edge of the collar and the base at the front face being less than the distance between the upper edge of the collar and the base at the rear face; and a plurality of pockets secured to the spacer at the front and side faces for the receipt and storage of golfing equipment, the upper edges of the pockets being at an elevational orientation beneath the upper edge of the handle.

3. The bag as set forth in claim 2 wherein the base, spacer and collar each have a circular cross sectional configuration.

4. The bag as set forth in claim 2 wherein the handle is secured at its upper end to the spacer adjacent to the collar.

5. The bag as set forth in claim 2 and further including a shoulder strap having its upper edge secured to the spacer adjacent to the collar and with the lower edge thereof secured to the spacer below the midpoint thereof.

6. The bag as set forth in claim 2 and further including supplemental belt loops secured to the spacer on opposite sides of the handle at a common elevational height.

7. The bag as set forth in claim 2 and further including a pair of cross bars within the rigid collar, the rigid cross bar closer to the rear face being at an elevational orientation higher than the cross bar adjacent to the front face.

8. The bag as set forth in claim 7 and further including sheets, each secured to an associated cross bar and to the base for separating golf clubs located within the bag.

9. The bag as set forth in claim 2 wherein the rear face of the bag is devoid of pockets for positioning the bag adjacent a golf cart.

* * * * *